United States Patent [19]

Moll

[11] Patent Number: 4,774,694

[45] **Date of Patent: * Sep. 27, 1988**

[54] WELL INFORMATION TELEMETRY BY VARIATION OF MUD FLOW RATE

[75] Inventor: Helmut Moll, Irvine, Calif.

[73] Assignee: Scientific Drilling International, Houston, Tex.

[ * ] Notice: The portion of the term of this patent subsequent to Sep. 15, 2004 has been disclaimed.

[21] Appl. No.: 78,797

[22] Filed: Jul. 27, 1987

Related U.S. Application Data

[63] Continuation of Ser. No. 895,135, Aug. 11, 1986, Pat. No. 4,694,439, which is a continuation of Ser. No. 757,182, Jul. 18, 1985, which is a continuation of Ser. No. 330,836, Dec. 15, 1981, abandoned.

[51] Int. Cl.[4] ..... G01V 1/40

[52] U.S. Cl. ..... 367/83; 175/48

[58] Field of Search ..... 367/81-85; 175/40-48; 340/853; 181/102; 73/151-155

[56] References Cited

U.S. PATENT DOCUMENTS

| | | | |
|---|---|---|---|
| Re. 28,436 | 6/1975 | Vitter | 73/151 |
| 2,290,408 | 7/1942 | Crites | 175/48 |
| 3,455,401 | 7/1969 | Taylor, Jr. | 175/45 |
| 3,711,825 | 1/1973 | Claycomb | 367/83 |
| 3,813,656 | 5/1974 | Fowler | 367/85 |
| 3,908,453 | 9/1975 | Jeter | 367/81 |
| 3,958,217 | 5/1976 | Spinnler | 367/85 |
| 3,960,015 | 6/1976 | Jett et al. | 73/155 |
| 3,983,948 | 10/1976 | Jeter | 175/45 |
| 4,078,620 | 3/1978 | Westlake et al. | 175/48 |
| 4,188,624 | 2/1980 | Hochaprung et al. | 340/606 |
| 4,266,606 | 5/1981 | Stone | 73/151 |
| 4,303,994 | 1/1981 | Tanguy | 367/84 |
| 4,405,021 | 9/1983 | Mumby | 175/48 |
| 4,553,226 | 11/1985 | Scherbatskoy | 367/85 |
| 4,694,439 | 9/1987 | Moll | 367/83 |

*Primary Examiner*—Thomas H. Tarcza
*Assistant Examiner*—Ian J. Lobo
*Attorney, Agent, or Firm*—William W. Haefliger

[57] ABSTRACT

Information is conveyed from a downhole location within a well, by varying the rate of flow of drilling fluid at the downhole location in accordance with changes in a predetermined condition at that location, and then sensing variations in the rate of flow of the drilling fluid at the surface of the earth as an indication of the downhole information being transmitted. A readout unit can be actuated in accordance with the information sensed at the surface of the earth to give a visual indication or other output representative of or dependent upon the downhole information.

16 Claims, 3 Drawing Sheets

WELL INFORMATION TELEMETRY BY VARIATION OF MUD FLOW RATE

This application is a continuation of Ser. No. 895,135 filed Aug. 11, 1986, now U.S. Pat. No. 4,694,439, which is a continuation of Ser. No. 757,182, filed July 18, 1985, which is a continuation of Ser. No. 330,836 filed Dec. 15, 1981, now abandoned.

BACKGROUND OF THE INVENTION

This invention relates to improved apparatus and methods for conveying information from a downhole location deep within a well to the surface of the earth; in order to apprise a driller of one or more conditions which exist in the well.

During drilling of a well, it is essential in most instances that frequently updated information be obtained as to the conditions which exist at the bottom of the well. For example, the inclination of the lower portion of the drill string and the direction of that inclination are often of critical importance, particularly in directional drilling, in order to assure that the hole is drilled along an intended path. Similarly, it may be desirable to convey to the surface of the earth information relative to temperature and pressure conditions at the bottom of the hole, the weight which is applied to the bit at a particular instant, and other parameters important to ulimate completion of a satisfactory drilling operation.

In the past, much of this downhole information has been obtained by instruments which have been lowered into the drill string on a wireline, and which after obtaining the information are withdrawn upwardly from the drill string before the drilling operation can be continued. In order to avoid the necessity for lowering an instrument into the drill string on a wire line, attemps have been made to devise systems for conveying information from a downhole location to the surface of the earth by telemetry not requiring a wire line. Some of these systems contemplate development of pressure pulses in the drilling fluid, with sensors being employed at the surface of the earth for responding to those pressure pulses and producing an output therefrom representing the downhole information. In some instances, a pressure pulse is produced by momentarily bypassing some of the circulating fluid at a location above the bit from the interior of the drill string to its exterior. In other types of equipment, a pressure pulse has been caused by closing a valve through which drilling fluid flows downwardly within the drill string and toward the bit. In either case, the surface equipment responds to the momentary increase or decrease in pressure resulting from actuation of a valve at the downhole location.

SUMMARY OF THE INVENTION

The present invention provides a different and improved arrangement for transmitting information from a downhole location to the surface of the earth without the use of wire lines. Apparatus and methods embodying the present invention can be employed to convey information to the surface of the earth either with the drilling bit stationary or while it is turning during an actual drilling operation. In the latter case, corrections can be made in the direction of drilling or in other drilling conditions while the bit turns and while completely updated information is being continuously supplied to an operator at the surface of the earth, indicating precisely what results are attained by any changes made in the drilling equipment. The apparatus which accomplishes this result, however, may be very simple structurally, rugged in construction, and adapted to function in a very straightforward manner for reliable trouble free operation over long periods of time.

The equipment of the invention employs apparatus at the surface of the earth which acts to sense variations in the rate of flow of the drilling fluid, and then controls a readout unit to produce an output dependent upon such variations in flow rate. The downhole equipment alters the flow rate of the circulation fluid in a pattern representing information which is to be conveyed to the surface, and the surface equipment in responding to the flow rate variations acts to receive that information. The downhole apparatus for controllably altering the drilling fluid flow rate may include a valve or valves acting to bypass the fluid from the interior to the exterior of the drill string or acting to vary the rate of fluid flow downwardly through the string.

The flow rate sensor at the surface of the earth may be of any known type, such as a mechanical, electronic or optical sensor. Alternatively, response to the change in rate of fluid flow at the surface may be attained by monitoring changes in the rate of operation of the mud pump which delivers drilling fluid to the upper end of the drill string. For example, the rate of operation of the mud pump may be monitored acoustically, with the derived acoustical signals being employed to control a readout unit.

BRIEF DESCRIPTION OF THE DRAWINGS

The above and other features and objects of the invention will be better understood from the following detailed description of the typical embodiments illustrated in the accompanying drawings, in which.

DESCRIPTION OF THE PREFERRED EMBODIMENTS

Figure 1:
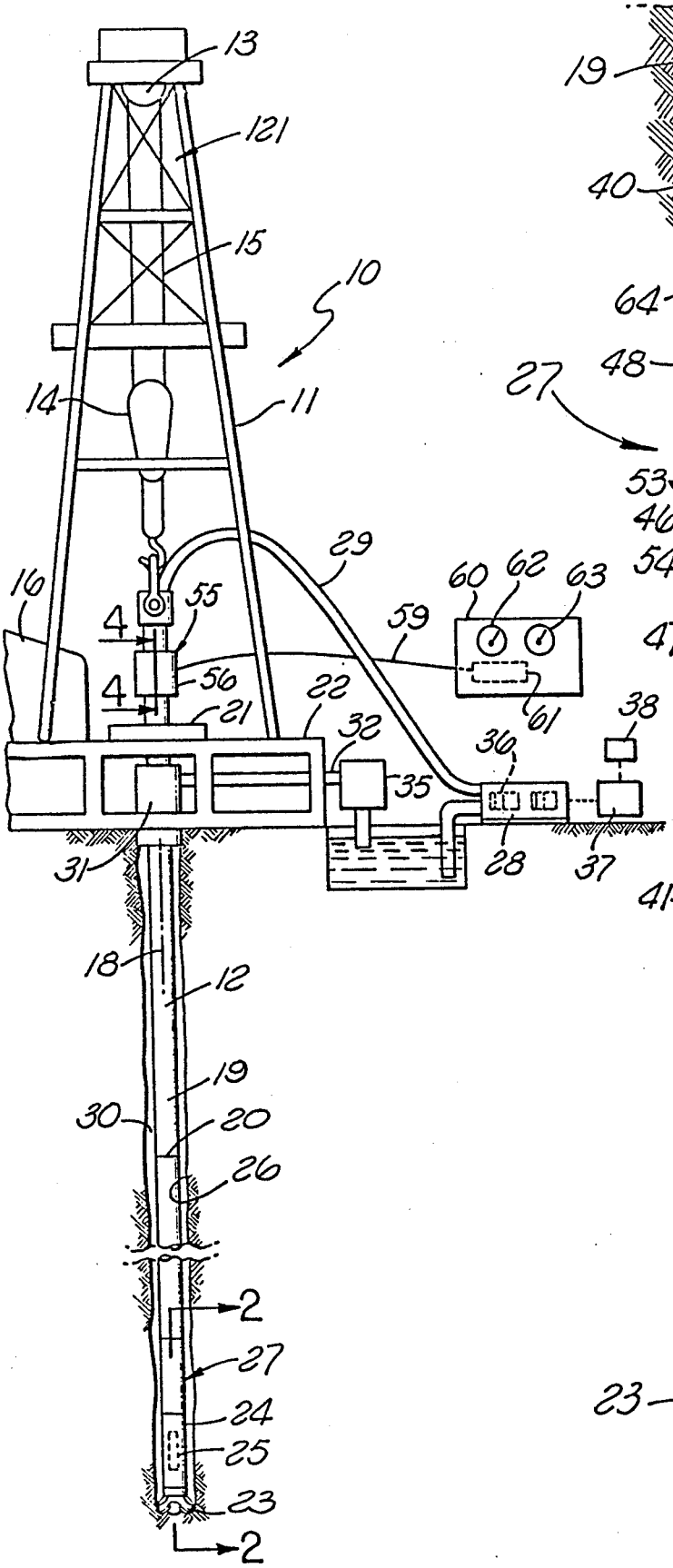
FIG. 1 is a diagrammatic representation of a well drilling rig provided with telemetry apparatus embodying the present invention.

There is illustrated diagrammatically at 10 in FIG. 1 a well drilling rig which is in most respects conventional, and includes the usual upwardly projecting derrick or mast 11 from which a drill string 12 is suspended by a block and tackle assembly 121 including a crown block 13 and a traveling block 14 suspended from the crown block by a line 15. The drawworks 16 actuates line 15 to move the traveling block and drill string upwardly and downwardly along a vertical axis 18. The string is formed of a series of tubular pipe sections 19 threadedly interconnected in end to end relation at joints 20. It is contemplated that for purposes of the present invention, the apparatus may either be of a type in which the entire string is rotated by a rotary table 21 mounted on the rig floor 22, or of a type in which the string is stationary and only the bit 23 at its lower end rotates. FIG. 1 typically illustrates the latter arrangement, with the lowermost section 24 of the drill string containing a motor 25 of known type adapted to be driven by the pressure of drilling fluid circulated downwardly through the drill string to turn bit 23 about axis 18 for progressively drilling well 26 as the string is lowered relative to the rig framework structure. Connected into the string above the bottom motor section 24 is an instrument section 27 which develops and transmits the information to be conveyed to the surface of the earth.

The drilling fluid or mud is delivered under pressure by a pump 28 through a flexible hose 29 to the upper end of the drill string 19, and flows downwardly through that string to bit 23, at which the fluid is discharged through restricted passages in the bit to the outside of the string, to flow upwardly through the annulus 30 about the string to the upper end of the well. At the upper end of the well, the returning fluid received from annulus 30 is confined within a structure 31, and is discharged from that structure through a line represented at 32 to a collection sump 33 from which pump 28 takes suction through a line 34 for recirculation of the fluid to the well. Before recirculation of the fluid, cuttings and other unwanted materials may be separated out of the fluid by a screen, filter or other separation system represented diagrammatically at 35.

Pump 28 is preferably of the positive displacement type, typically including one or more piston and cylinder mechanisms represented at 36 in FIG. 1, and with the pump being driven by a motor 37 at a rate which can be varied by a control represented at 38.

Figure 2:
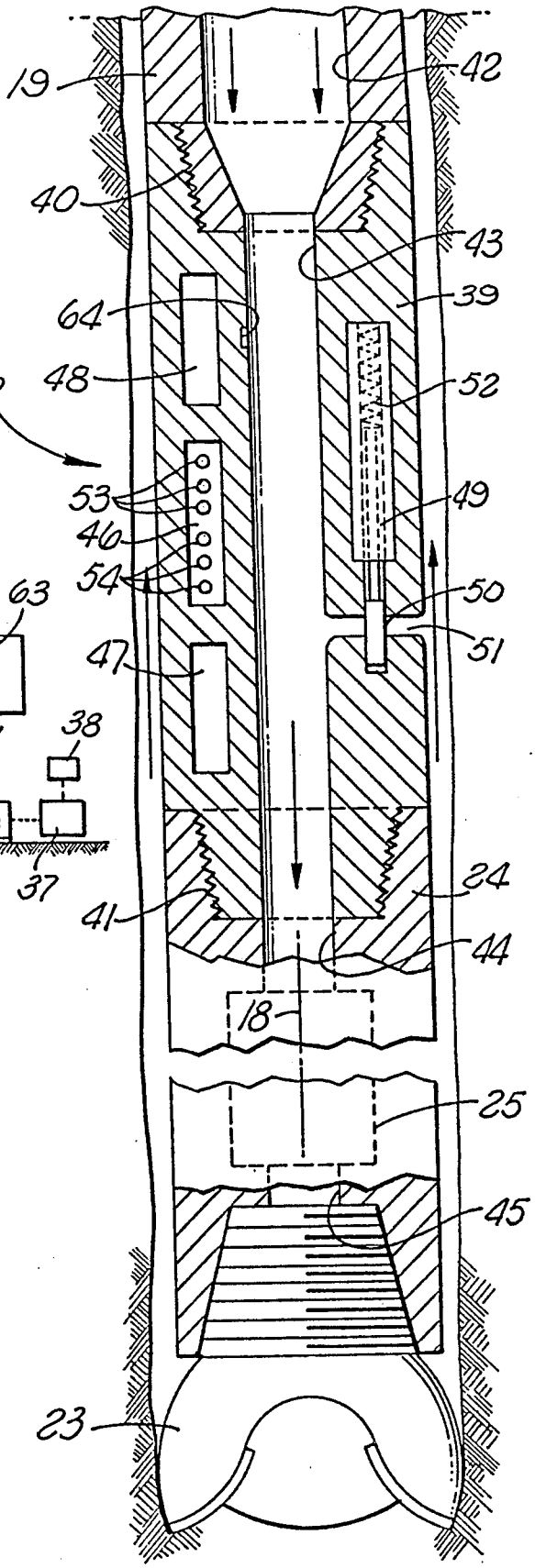
FIG. 2 is an enlarged vertical section taken on line 2—2 of FIG. 1, and showing somewhat schematically the downhole portion of the apparatus of FIG. 1, with a drilling fluid bypassing valve in its closed condition.

Referring now to FIG. 2, the instrument or tool section 27 of the drill string has a rigid tubular body 39 centered about axis 18 of the string and having its upper end threadedly connected at 40 to the next upper section 19 of the string and having its lower end threadedly connected at 41 to the lowermost section 24 of the string which contains and carries the mud motor. The drilling fluid flows downwardly from a passage 42 formed in the string above instrument section 27 into an axial passage 43 formed in body 39, and from the lower end of passage 43 flows into a passage 44 in bottom section 24 to drive motor 25 and then be discharged through a passage represented at 45 to the bit.

The active elements of instrument section 27 of the string are preferably contained within cavities formed in the relatively thick sidewall of body 39 of section 27, in order to isolate most of these elements from contact with the inherently abrasive drilling fluid or mud flowing downwardly through passage 43 in body 39. These active elements of section 27 may include an instrument 46 adapted to sense a condition or conditions in the well, battery pack 47 for energizing the instrument and other related parts, an electronic circuit 48, and an electrically operated device 49 for actuating a valve 50 between open and closed positions. Valve 50 acts to control flow of the circulating fluid from passage 43 through a passage 51 in the side wall of body 39 to the exterior of that body. The valve 50 may be a gate valve which is actuable vertically between the closed condition of FIG. 2 in which it blocks flow of fluid laterally from passage 43 and the open position of FIG. 3 in which fluid is permitted to bypass laterally through passage 51 to the annulus about body 39 without flow through motor 25 and the bit. The actuator 49 for valve 50 may be a solenoid which opens the valve when energized and permits closure of the valve by a spring represented at 52 when the solenoid is energized.

Instrument 46 may be capable of responding to any condition in the well which is of significance to the drilling operation and about which information is to be conveyed to the surface of the earth. For example, the instrument may be a unit such as those shown in U.S. Pat. Nos. 3,791,043 issued Feb. 12, 1974 entitled "Indicating Instruments", Michael King Russell, Inventor, and 3,862,499 issued Jan. 28, 1975 entitled "Well Surveying Apparatus", Carroll E. Isham et al, Inventors, for sensing the inclination of the lower portion of a drill string and the direction of that inclination. More specifically, instrument 46 may contain two or three gravity sensors 53 adapted to respond to or sense different components of inclination of the instrument with respect to three different mutually perpendicular axes fixed relative to the instrument body, and two or three magnetic sensors 54 adapted to respond to different mutually perpendicular components of the earth's magnetic field for determining the compass direction in which the instrument is inclined. The signals developed by sensors 53 and 54 are delivered to electronic circuit 48, which delivers them in an appropriately multiplexed sequential fashion to solenoid 49 to open and close valve 50 in correspondence with the sensed values. The multiplexed signals delivered by circuit 48 to solenoid 49 open and close valve 50 in a predetermined pattern representing in a known coded fashion the values sensed by elements 53 and 54.

Each time the valve 50 is opened, the bypassing of fluid through passage 51 from the interior of body 39 to its exterior results in an increased flow of circulating fluid downwardly through the drill string from its upper end. The setting of motor 37 which drives mud pump 28 is not changed while signals are being transmitted to the earth through the circulating fluid string, with the result that the opening of valve 50 reduces the resistance to flow of the fluid downwardly through the string and permits pump 28 to operate at an increased rate by virtue of the reduction in resistance to flow. Conversely, when valve 50 is closed, the increased resistance to downward flow of the fluid through the drill string causes pump 28 and its driving motor 37 to operate at a reduced speed with reduced downward flow of the fluid.

Figure 4:
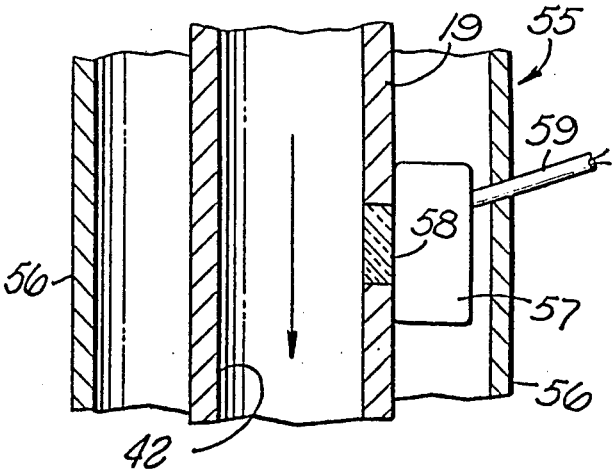
FIG. 4 is an enlarged fragmentary vertical section taken on line 4—4 of FIG. 1, and showing the surface flow sensing equipment utilizing an optical flow meter arrangement.

To sense and respond to these changes in fluid flow rate, I provide at the upper end of the string a flow sensor assembly 55, which may typically include an annular housing 56 disposed about an upper portion of the drill string above rotary table 21 and containing a sensor proper represented diagrammatically at 57 in FIG. 4. In that figure, the sensor 57 is assumed to be of an optical type, positioned at the outside of a transparent window 58 connected into the side wall of an upper section 19 of the drill string in sealed relation. Unit 57 illuminates the interior of the drill string and the circulating fluid flowing downwardly therethrough, and responds visually to the rate of flow of that fluid to function as a flow meter producing an electrical output signal in lines 59 representing the rate of flow of the fluid downwardly through the drill string. This flow rate signal in lines 59 is delivered to a readout unit 60 which is located on or near the rig at the surface of the earth, and which contains electronic circuitry 61 acting to decode the signals transmitted by variations in fluid flow rate from the downhole location, and acting to electronically process that data in a manner deriving desired output information therefrom for actuating indicators 62 and 63 to display that information. One of these indicators may be a dial device indicating in degrees the inclination of downhole instrument 46 and the lower portion of the drill string relative to the vertical, while the second indicator 63 may be a dial device whose pointer represents in degrees the azimuth or compass direction of that inclination and/or the number of degrees through which section 27 of the drill string is turned about its longitudinal axis from a predetermined position in which a certain side of body 39 or an index marking thereon is at the "high side" of an inclined hole.

During the drilling of a well by the apparatus shown in FIGS. 1 to 4, it is contemplated that in most instances the information sensed at the bottom of the well will not be conveyed to the surface of the earth continuously, but will be transmitted only intermittently at such intervals as are required to properly monitor the drilling operation. Appropriate means may be provided for initiating such intermittent operation of the downhole sensing equipment and its controlled valve 50. For example, if desired, the electronic circuitry 48 may include a timing circuit acting to energize instrument 46 and the related circuitry and actuate solenoid 49 and valve 50 through a cycle of information transmitting operation at predetermined timed intervals. Alternatively, unit 27 may contain an element 64 which is capable of responding to a signal transmitted from the surface of the earth to the downhole location to initiate a cycle of operation of the sensing and signal transmitting equipment. For example, element 64 may be a pressureresponsive switch connected into the side wall 39 of passage 43 in section 27, and adapted to respond to a predetermined increase or other change in fluid pressure in passage 43 to commence actuation of the sensing and signal transmitting equipment through a cycle of operation. Desirably, switch 64 responds to a pressure considerably in excess of the normal pressure maintained in passage 43 by the mud pump 28, and acts when the pressure is momentarily increased to that value and then reduced to the normal operating pressure to commence the cycle of operation of sensors 53 and 54, circuitry 48, solenoid 49 and valve 50.

To recapitulate briefly the manner in which a well is drilled utilizing the equipment of FIGS. 1 through 4, during most of the drilling operation valve 50 is in the condition represented in FIG. 2, and the circulating fluid delivered by pump 28 to the upper end of the drill string flows downwardly through the string and through passage 43 to mud motor 25, which is then driven by the fluid to turnbit 23, with the fluid charging from the bit and flowing upwardly through annulus 30 for return to pump 28 and recirculation thereby. During such drilling, the pressure applied by the circulating fluid to pressure switch 64 is not great enough to activate the sensing circuitry of section 27, and therefore valve 50 is held in closed condition. When it is desired to utilize the instrument section 27 for sensing inclination and the direction of that inclination (or another condition of the well), the operator first actuates control 38 of motor 37 to increase the rate of operation of the pump 28 and thereby increase the pressure at switch 64 to a predetermined value to which that switch responds, after which the speed of the pump is reduced to the original drilling condition. Electronic circuitry 48 responds to this momentary increase and then decrease in pressure in passage 43 to energize the circuitry associated with sensors 53 and 54, and cause delivery of a cycle of multiplexed signals from unit 48 to solenoid 49 acting to open and close valve 50 in a coded pattern representing gravity and direction components sensed by elements 53 and 54. Each time valve 50 opens, it bypasses some of the fluid from within passage 48 to reduce the resistance to downward flow of fluid through the drill string above the location of passage 51 and thereby permit pump 28 to operate at an increased speed. The resultant increase in the rate of flow downwardly through the portion of the drill string which is within flow rate sensor or meter assembly 55 is sensed by element 57 of FIG. 4, which delivers a corresponding signal to readout unit 60. Circuitry 61 of that unit decodes and processes an entire series of such signals received from the flow sensor and actuates the pointers of dial devices 62 and 63 to indicate to an operator the inclination of the lower portion of the well and the direction of that inclination. After a cycle of such operation of the signal transmitting equipment, downhole circuitry 48 automatically returns to its initial condition in which sensors 53 and 54 are ineffective to control valve 50, and that valve is maintained in closed condition until the next successive operating cycle.

Figure 5:
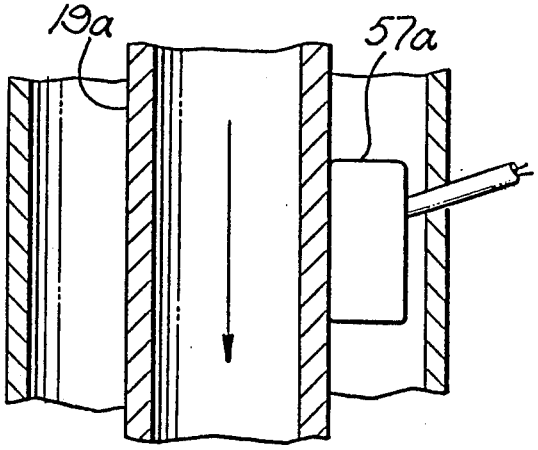
FIG. 5 is a view similar to FIG. 4 but showing schematically an electronic or magnetic flow meter arrangement.

FIG. 5 represents schematically a variational arrangement in which a sensor element **57*a* utilized in lieu of optical sensor 57 of FIG. 4 is adapted to respond electronically or magnetically to changes in the rate of downward flow of drilling fluid through drill string 19*a*. When such an electronic or magnetic sensor is employed, the drilling fluid is compounded to include particles of an appropriate electrically conductive or magnetic substance capable of producing the desired flow meter output from sensor 57*a***.

Figure 6:
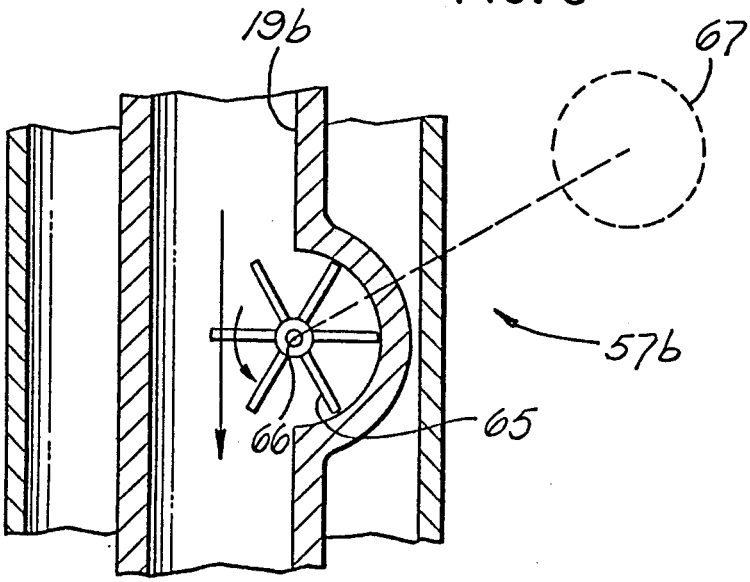
FIG. 6 is a view similar to FIG. 4, but showing use of a mechanical flow meter.

FIG. 6 shows another variational arrangement in which there is substituted for the optical sensor of FIG. 4 or the electronic or magnetic sensor of FIG. 5 a mechanical sensor **57*b*, including a paddle wheel element 65 which is exposed to the flow of circulating fluid downwardly through the upper portion 19*b* of the drill string above the rotary table, and which turns about an axis 66 at a rate corresponding to the rate of downward flow of the fluid and acts to drive a unit 67 which develops an electrical output corresponding to the rate of fluid flow, to be delivered to readout unit 60 for controlling the operation of indicators 62 and 63**.

Figure 7:
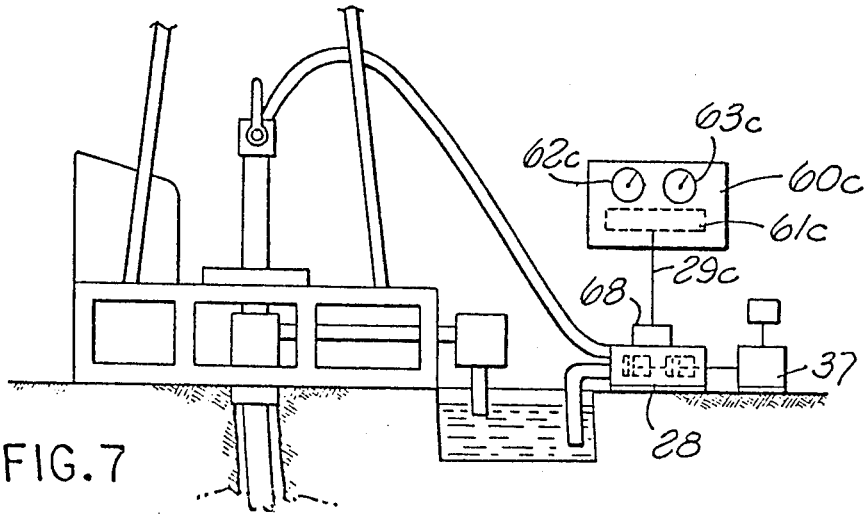
FIG. 7 represents fragmentarily an acoustical flow sensing system.

FIG. 7 shows another arrangement for sensing variations in the rate of flow of the fluid downwardly through the drill string, to be utilized in lieu of the sensors of FIGS. 4, 5 and 6. In FIG. 7, the rate of flow of the fluid is sensed by responding to variations in the rate at which pump 28 is driven by motor 37. As indicated previously, when valve 50 at the downhole location is opened, the rate of operation of pump 28 by motor 37 automatically increases. In FIG. 7, this increase in speed of the pump is sensed by an element 68, which may be an acoustical sensor responding to the increase in frequency of the reciprocations of the pistons of pump 28, and acting to deliver electrical signals representing those pump speed variations through a line 69 to readout unit 60c, containing an electronic circuit 63c which decodes and processes the information from sensor 68 and actuates indicators 62c and 63c in correspondence therewith to represent the information sensed at the downhole location.

Figure 3:
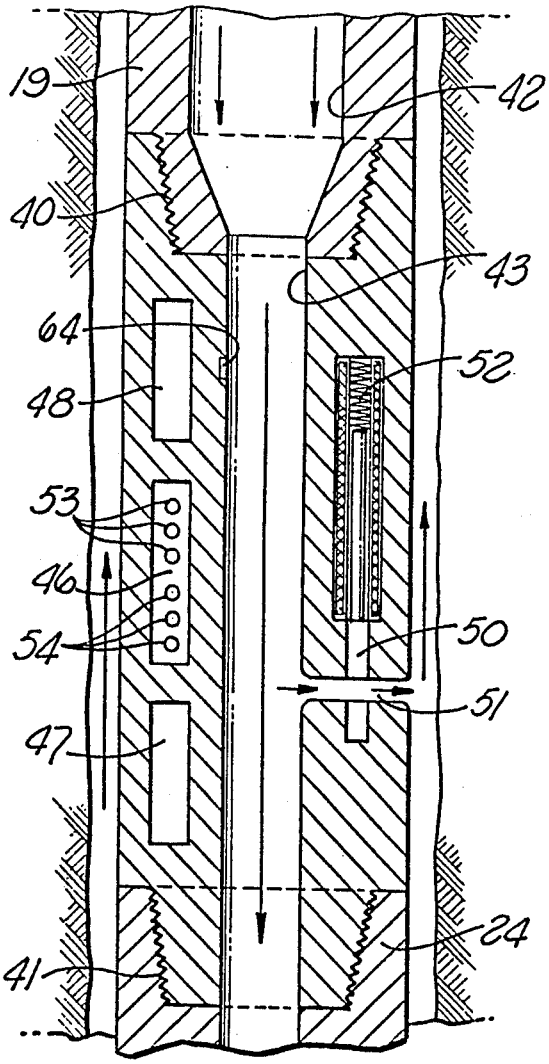
FIG. 3 is a view similar to FIG. 2, but showing the valve in its open condition.
Figure 8:
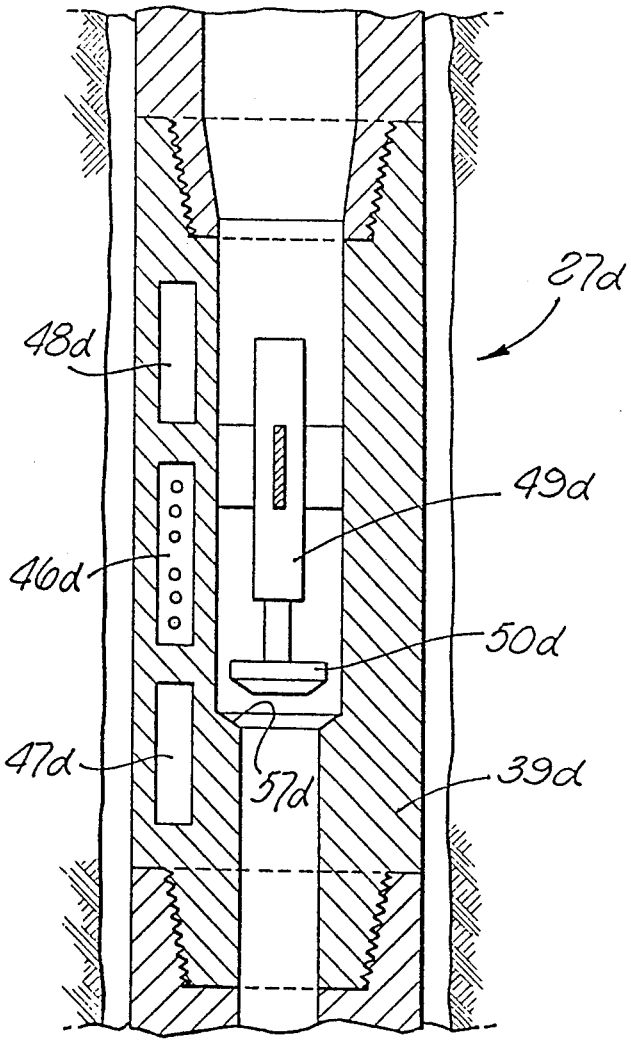
FIG. 8 shows a variational arrangement in which the valve regulates flow of fluid downwardly through the drill string rather than between its interior and exterior.

FIG. 8 shows a variational form of downhole instrument section 27d which can be substituted for section 27 of FIGS. 1 to 3 to vary the rate of downward flow of fluid through the interior of the drill string in a different manner. In lieu of valve 50 of FIGS. 2 and 3, the unit 27d of FIG. 8 includes a valve 50d which is actuable upwardly and downwardly by solenoid 49d between open and closed positions relative to an annular seat 51b formed in the interior of the body 39d of section 27d. In this arrangment, there is no bypassing of fluid from the interior to the exterior of body 39d, but instead valve 50d acts when momentarily closed to temporarily interrupt downward flow of drilling fluid through the drill string to the mud motor and bit. Operation of the valve is under the control of an instrument 46d which may be the same as instrument 46 of FIGS. 2 and 3 to sense inclination or azimuth or any other desired downhole condition, with batteries 47d energizing the instrument and an electronic circuit 48d which delivers coded information to solenoid 49d representing the information sensed by instrument 46d, to actaute valve 50d in correspondence with that information. As will be understood, each time the valve 50d is closed, the rate of downward flow of fluid is reduced, and that change in rate of flow can be sensed by any of the flow meter units of FIGS. 4, 5, 6 or 7, or their equivalent, to actuate the readout unit in correspondence with and in a manner representing the information sensed deep within the well.

In addition to the various arrangements specifically described above, it is contemplated as previously mentioned that the telemetering apparatus of the present invention may be utilized in a drilling rig in which the entire drill string is turned by the rotary table 21 to rotate bit 23 in the well. In that event, the bit is rigidly carried by the lower end of the string, and mud motor 25 is omitted from the apparatus.

While certain specific embodiments of the present invention have been disclosed as typical, the invention is of course not limited to these particular forms, but rather is applicable broadly to all such variations as fall within the scope of the appended claims.

I claim:

1. Apparatus for conveying information from a downhole location within a well in which circulating fluid flows in a line extending from the well surface downwardly to said location and then returns to the well surface, comprising:

a drill string extending downwardly within the well and carrying a bit at its lower end; the string forming said line;

means for varying the rate of flow of said circulating fluid in said line by controllably operating valving at said downhole location and in correspondence with said information to be conveyed to the surface of the earth;

means of sensing variations in the rate of flow of said fluid near the well surface as an indication of said information;

and motor driven pump means operating to pump the fluid to flow in said line, the motor set to cause the rate of flow from the pump to increase and decrease in correspondence to said operating of said valving;

said flow rate sensing means sensing variations in the speed of operation of the pump means, and including readout means responsive to the sensing means, and operable to produce and output representative of or dependent upon the downhole information.

2. Apparatus as recited in claim 1, in which said sensing means includes a flow meter responsive to variations in the rate of flow of circulating fluid into the upper end of said well and downwardly therethrough.

3. Apparatus as recited in claim 1 including readout means responsive to said flow rate sensing means to produce an output representative of or dependent upon said information.

4. Apparatus as recited in claim 1, including display means at the well surface responsive to said flow rate sensing means to produce a visual display representative of or dependent upon said downhole information.

5. Apparatus as recited in claim 1, in which said valving includes a passage in the string operable to bypass circulating fluid from the interior of the side string in the well to its exterior, and a valve stopper to open and close said passage, and means for actuating said stopper in correspondence with said information to vary the fluid through said valving in a relation altering the overall rate of fluid flow through the well.

6. Apparatus as recited in claim 1, in which said valving includes a passage in the string to pass fluid flow downwardly through the lowermost extent of the pipe string in the well, and a valve stopper operable to open and close said passage to vary the rate of fluid flow through the string to the lower end thereof.

7. Apparatus as recited in claim 1, including an instrument within the well near said downhole location operable to sense variations in a downhole condition and deliver an output representative of said variations in said condition to said flow rate varying means as information to be conveyed to the surface of the earth.

8. Apparatus as recited in claim 1, including an instrument received within the pipe string at said downhole location and which is responsive to the inclination of the well and the direction of that inclination and produces an output to said flow rate varying means representative of said inclination and direction and constituting said information to be conveyed to the surface of the earth, said sensing means including a flow meter near the surface of the earth responsive to variations in the rate of delivery of circulating fluid to the upper end of said pipe string for flow downwardly therethrough, said apparatus including readout means responsive to said flow rate sensing means to produce an output at the surface of the earth representative of or dependent upon said inclination and direction sensed by said instrument.

9. Apparatus for conveying information from a downhole location within a well in which circulating fluid flows in a line extending from the well surface downwardly to said location and then returns to the well surface, comprising:

a drill string extending downwardly within the well and carrying a bit at its lower end; the string including said line, means for varying the rate of flow of said circulating fluid in said line by controllably operating valving at said downhole location and in correspondence with said information to be conveyed to the surface of the earth;

means for sensing variations in the rate of flow of said fluid near the well surface as in indication of said information;

and motor driven pump means operating to pump the fluid to flow in said line, the motor set to cause the rate of flow from the pump to increase and decrease in correspondence to said operating of said valving, said flow rate sensing means including means for acoustically sensing variations in the operating speed of said pump means as an indication of said variations in the rate of fluid flow, there being readout means responsive to said acoustic sensing means and operable to produce an output representative of or dependent upon said downhole information.

10. The method of transmitting information to the surface of the earth from a downhole location within a well pipe defined by a drill string and in which circulating fluid flows downwardly to said location and then back to the surface of the earth outside the string, the drill string extending downwardly within the well and carrying a bit at its lower end; comprising:

connecting valving to the string and operating said valving to vary the flow of said circulating fluid at said downhole location in the well pipe in correspondence with said information; said flow variations being correspondingly effected in substantially the entirety of the well pipe above said downhole location; and sensing variations in the flow of said fluid near the surface of the earth as an indication of said information, said circulating fluid produced by pump means whose speed is effectively sensed, and including operating a motor driving the pump means to allow pump speed to vary as the valving varies said flow of the fluid.

11. The method as recited in claim 10, in which the rate of flow of said circulating fluid at said downhole location is varied by variably bypassing circulating fluid from the interior of the well pipe in the well to its exterior at said downhole location.

12. The method as recited in claim 10, in which said well pipe carries a motor near its lower end driven hy said circulating fluid to turn a bit for drilling the well, said flow of circulating fluid at said downhole location being varied by variably bypassing a portion of the circulating fluid from the interior of the pipe upstream of said motor to the exterior of the pipe, the remainder of the fluid flowing to the motor.

13. The method as recited in claim 10, including producing an output at the surface of the earth indicative of or dependent upon variations in the flow of said fluid near the surface of the earth.

14. The method as recited in claim 10, in which said last step of the claim includes sensing variations in the rate of flow of said fluid into the upper end of the pipe string in the well.

15. The method of transmitting information to the surface of the earth from a downhole location within a well pipe defined by a drill string in which circulating fluid flows downwardly to said location and then back to the surface of the earth outside the string, the drill string extending downwardly within the well and carrying a bit at its lower end; comprising:

connecting valving to the string and operating the valving to vary the flow of said circulating fluid at said downhole location in the well pipe in correspondence with said information; said flow variations being correspondingly effected in substantially the entirety of the well pipe above said downhole location; and sensing variations in the flow of said fluid near the surface of the earth as an indication of said information, said circulating fluid being delivered to the well pipe under pressure exerted by reciprocating pump means, said sensing of variations in the flow of fluid near the surface of the earth being effected by sensing changes in the reciprocation of said pump means, and including operating a motor driving said pump means to allow the speed of the pump means to increase and decrease as the valving decreasingly and increasingly restricts the fluid flow.

16. The method as recited in claim 15, in which said circulating fluid is delivered to the upper end of a drill string in the well pump means, and in which there is a motor carried by the string near its lower end and driven by said circulating fluid to turn a bit for drilling the well, said varying of the rate of flow of said circulating fluid at said downhole location being effected by variably bypassing circulating fluid from within the drill string upstream of said motor to the exterior of the string, said sensing of variations in the rate of flow near the surface of the earth being effected by sensing changes in the rate of delivery of circulating fluid under pressure from said pump means to the drill string.

* * * * *